United States Patent [19]

Bigarella

[11] 4,091,932

[45] May 30, 1978

[54] CONTROL DEVICE FOR VIAL FILLING MACHINES

[76] Inventor: Federico Bigarella, Via S. Carlo 32, Segrate (Milano), Italy

[21] Appl. No.: 715,915

[22] Filed: Aug. 19, 1976

[30] Foreign Application Priority Data

Feb. 12, 1976 Italy ..... 20108 A/76

[51] Int. Cl.[2] ..... B07C 1/10

[52] U.S. Cl. ..... 209/82

[58] Field of Search ..... 209/80, 82, 88, 73, 209/74, 72

[56] References Cited

U.S. PATENT DOCUMENTS

| | | | |
|---|---|---|---|
| 2,352,091 | 6/1944 | Fedorchak | 209/88 R |
| 2,713,419 | 7/1955 | Hayes | 209/72 |
| 3,771,650 | 11/1973 | Henderson | 209/80 |

*Primary Examiner*—Allen N. Knowles

*Attorney, Agent, or Firm*—McGlew and Tuttle

[57] ABSTRACT

A control device for vial filling machines is disclosed. The device comprising a reciprocating slide carrying a plurality of sensors, and wherein a suitable member is provided for the removal of vials where such are presented in an unopened condition at a proper filling station in the apparatus.

8 Claims, 5 Drawing Figures

21

CONTROL DEVICE FOR VIAL FILLING MACHINES

BACKGROUND OF THE INVENTION

Field of the Invention

This invention relates to a device for removing a vial before a filling up station, should such a vial be presented without having been opened by a vial filling machine at the proper time.

DESCRIPTION OF THE PRIOR ART

Closed vial types of vial filling machines are already known, among which the so called "ballon" machines can be particularly mentioned, which machines are generally equipped with a loading station, a neck preheating and/or opening staion, a filling up station and a subsequent seal or capping re-closing station. These machines are completely automatic and exhibit high output rates, but suffer from a disadvantage in that, should a vial casually not open at the respective opening station, such a vial would in any case be present at the next filling station, with readily imaginable consequences.

SUMMARY OF THE INVENTION

In order to overcome such a disadvantage, the present invention proposes a device for controlling and automatically ejecting those vials that have not been duly opened at the opening station, the device substantially comprising a series of mechanical sensors which, in combination with extraction pliers, provide for ejecting the non-opened vials prior to reaching the filling station.

The present invention can be more fully understood from the following detailed description given by mere way of unrestrictive example, particularly referring to the figures of the accompanying drawings;

DESCRIPTION OF THE PREFERRED EMBODIMENT

Figure 1:
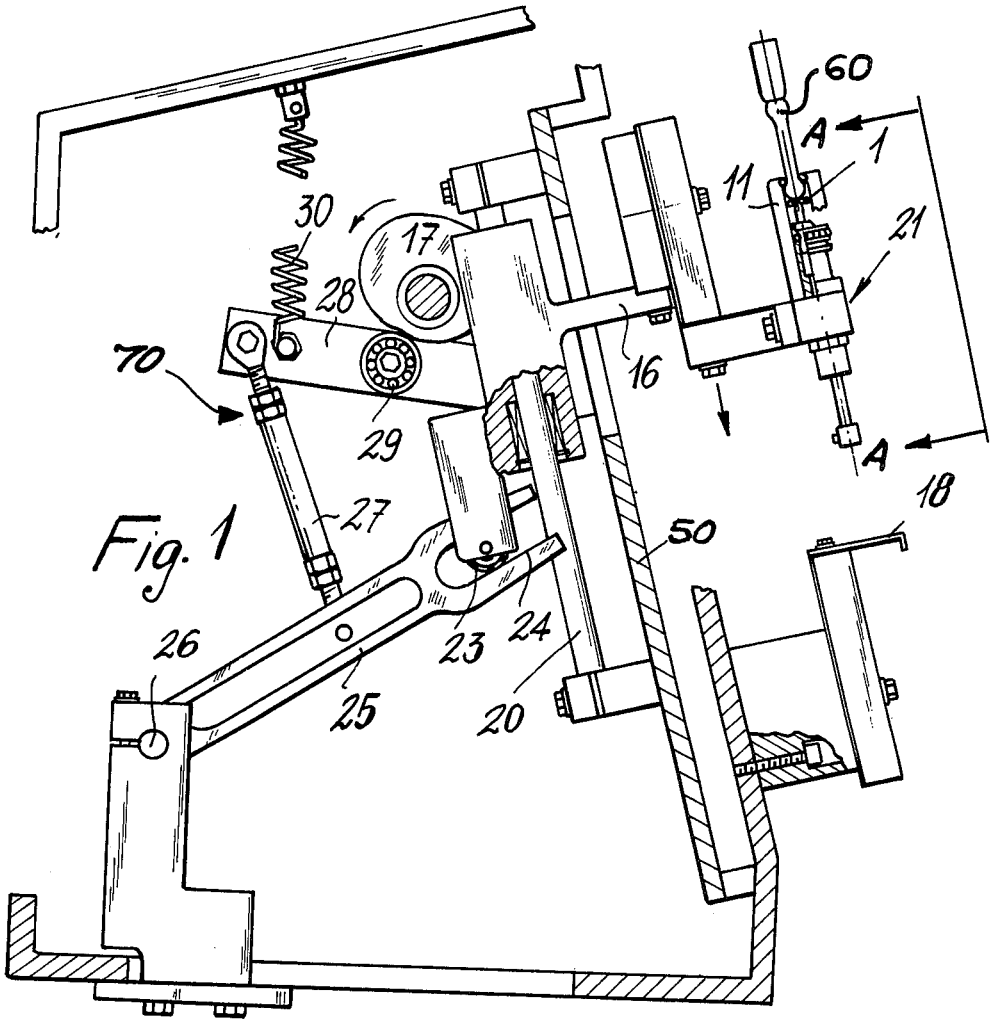
FIG. 1 is a partially front and sectional view showing the driving means for the device according to the invention.
Figure 2:
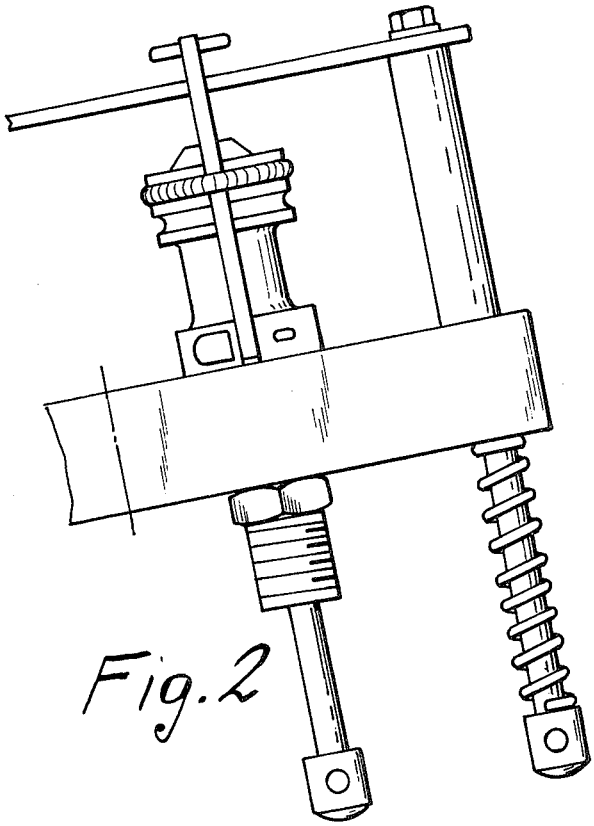
FIG. 2 is a view as seen from line A—A in FIG. 1.

A device according to the invention provided in connection with a fixed frame 50, made integral with the structure of the vial filling machine, a moving slide 16 slidable along guides 20 and cantilevered carrying an assembly of sensor and ejectors designated as a whole at 21. The movable slide 16 is moved to and fro by drive means generally designated 70 that is controlled by a bearing 23 sliding in a fork 24 of a first connecting rod 25 pivoted at 26 relative to the fixed frame or structure. In turn, this connecting rod 25 is driven by a tie rod-strut assembly 27 pivoted at one side on connecting rod 25 and at the other side on a lever 28 pivoted at the other end on said fixed structure or frame. Lever 28 is fitted with a ball bearing 29, on which a cam 17 is effective against the action of a spring 30, said cam being conventionally operated by a drive shaft.

The operation of this first part of the device will be apparent from the foregoing, and can be briefly summarized as follows: from the position shown in FIG. 1, upon rotation, cam 17 causes downward oscillation for lever 28 against the action of spring 30 and then through strut 27 causes downward rotation also for connecting rod 25 downward moving in the direction shown by the arrow said slide 16 and hence said sensor assembly 21. On continued rotation, and after passing the maximum eccentricity of the cam, said spring 30 causes an upward return movement of slide 16 toward a vial 60, the latter being thus provided with a reciprocating motion.

Figure 3:
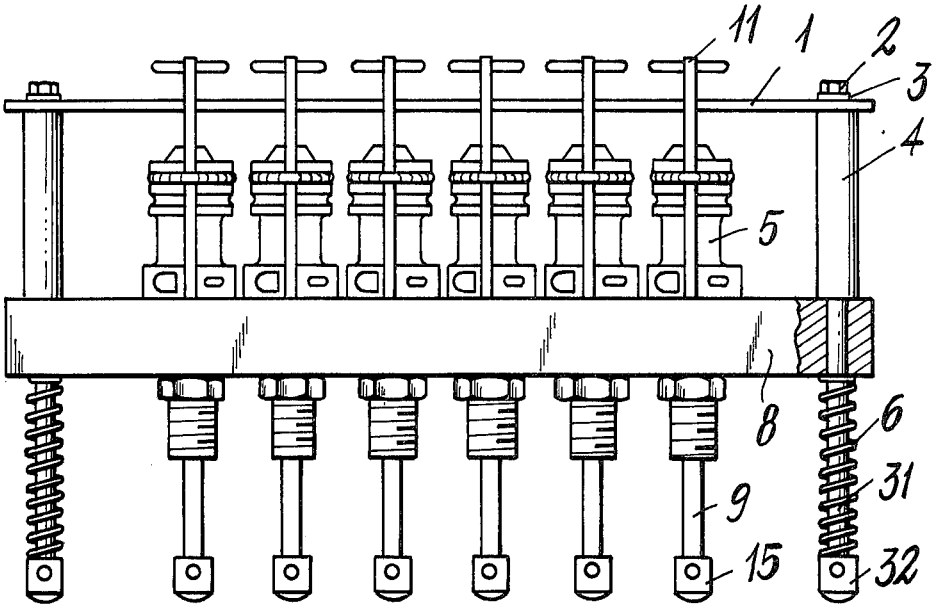
FIG. 3 particularly shows a device provided with six sensors.
Figure 4:
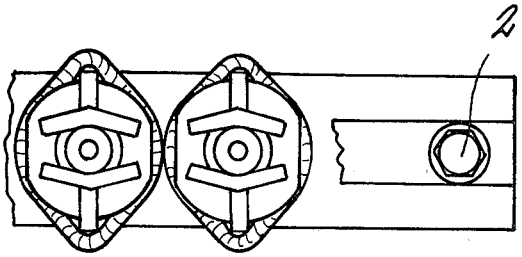
FIG. 4 is a partial top view of FIG. 3.

Sensor-ejector assembly 21 is particularly shown in FIGS. 3 and 4, in which reference numeral 1 designates a transverse bar, reference numeral 2 designates a bolt connecting bar 1 to a stud 4 which has a stem 31 that can freely pass through a large cross piece 8. A helical spring 6 is provided and bears at one end against a head 32 and at the other end against cross piece 8. Such a set of means is identically provided at the other end of the bar 1.

On said cross piece 8 and within the zone between the above described two end sets, a plurality of juxtaposed sensors are provided, the sensors being indentical to one another and substantially comprising sleeves 5 secured to cross piece 8 and wherein pins 9 at the bottom terminating in heads 15 can freely slide relative thereto, whereas at the top arms 11 are provided as opposite to one another, at the top terminating above said bar 1.

Figure 5:
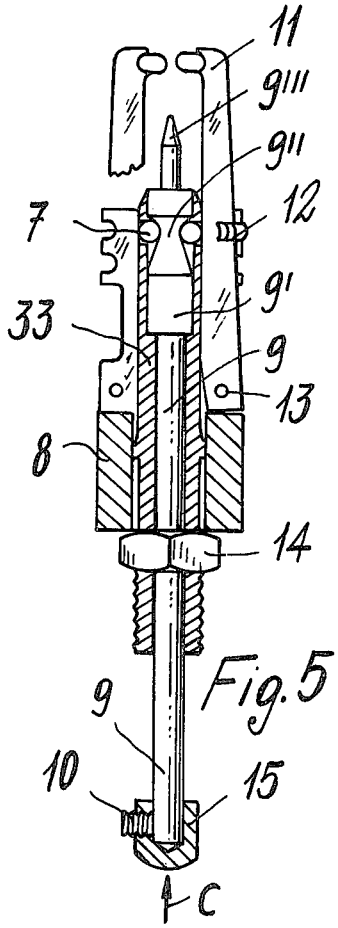
FIG 5 is a partially front and sectional view showing the details of a mechanical sensor with the associated pliers.

The constructive details for each of the sensors can be seen from FIG. 5. In this figure, it will be seen that spreadable apart arms 11 are pivoted at 13 to body or sleeve member 5, one or more springs 12 being provided for permanently inwardly clamping said arms 11. Pin 9 is freely slidable within a sleeve 33 integral with cross piece 8 and is provided at the upper end with a larger diameter zone, designated at 9', adjacent a tapered smaller diameter zone 9'', whereas the end terminates with a ferrule 9'''. At the top of sleeve 33, two or more holes are provided for the passage of balls 7 therethrough, which balls outwardly bear on the inner faces of arms 11. From the position shown in FIG. 5, it is clearly evident that when acting in the direction shown by arrow C pushing pin 9 relative to cross piece 8, the larger diameter zone 9' would be moved to a location at balls 7, causing arms 11 to spread apart against the action of spring 12.

According to the invention, a bearing plane or table 18 is provided (see FIG. 1), as suitably positioned for forming an end of stroke rest or bearing in the downward movement of said slide 16 for all of heads 15 and 32 of assembly 21.

All of this being stated, the operation of the automatic controlling and ejecting device according to the invention can be readily understood, which operation can be depicted as follows. The vials are supplied from the opening station to a second station, stopping thereat for glass cooling down at air contact. At the next station, the vials will encounter the device according to the invention. As above mentioned, the whole device is carried by a slide 16 (see FIG. 1), to which a reciprocating motion is given through crank mechanisms or gears 25, 26 and 27 by cam 17. On its downward movement, assembly 21 encounters fixed plane or table 18 with its heads 15, causing pins 9 to move relative to sleeves 5.

Thus, balls 7 will be located at larger diameter zone 9′ and accordingly cause arms 11 to be outwardly spread apart against the action of spring 12. Therefore, on approaching the vials (in direction C of FIG. 5), the device shown in FIG. 5 has pin 9 upwardly moved with balls 7 located at zone 9′. Should an encountered vial be duly open, the coned tip 9‴ of pin 9 would enter the vial neck and, as a result, arms 11 remain at spread apart condition. On the other hand, should a vial be presented as irregularly closed, it would collide against said sensing tip 9‴ and, as a result, pin 9 would downward move relative to sleeve member 5, just reaching to the position shown in FIG. 5. Accordingly, balls 7 will move to the groove corresponding to minor diameter zone 9″, and due to action of spring 12, said two arms 11 will close clamping around the vial neck, and upon downward movement of assembly 21 such a vial will be removed away from its usual cylinder or container. Still on downward movement, the two heads 32 of studs 31 will collide against the action of springs 6 with bearing plane or table 18, displacing said extracting bar 1 which, even through a short stroke, causes the vial to be extracted from beween said two arms 11 against the action of spring 12. Thus, when slide 16 moves assembly 21 toward table 18, pin 9 is pushed upwardly to open jaws or arms 11 and retain them in an open or set position. Slide 16 then moves upwardly toward the vials. If pin ferrule 9‴meets an uncapped vital or container, it is unmoved and the jaws remain open.

If, however, ferrule 9‴ meets a capped container, it is force downwardly in respect to cross piece 8 and balls 7 move into inclined portion 9″ to allow jaws 11 to close about the capped container. As slide 16 then again moves downwardly, the capped container will be pulled with it and later pushed from the jaws 11 by bar 1, to ve removed from the machine.

Although only one embodiment of the device according to the invention has been described, those skilled in the art can now devise many changes and modifications, all of which should be intended as within the scope of the present invention.

What is claimed is:

1. A device for separating capped containers from a series of capped and uncapped containers comprising, a support, a slide movable to and fro on said support, drive means associated with said slide to move it on said support, a jaw pivotally mounted on said slide, a pin slidable on said slide between said jaw from a first position in which said pin opens said jaw to a second position in which said pin closes said jaw, setting means aligned with said pin to contact said pin and move it to said first position during each fro movement of said slide on said support, said slide being movable toward each one of the series of containers in succession to allow a portion of said pin to enter each one of the series of uncapped containers and remain in its first position with said jaws open, and to cause said pin to be abutted against each one of the capped containers in the series for moving said pin into its second position to allow said jaws to close about the capped container and separate it from the series of containers during each fro movement of said slide.

2. A device according to claim 1, wherein said setting means comprises a table connected to said support adjacent said slide.

3. A device according to claim 1, wherein said drive means comprises a shaft rotatably on said support, a cam connected to said shaft, a lever having one end pivotally mounted to said shaft and a portion engageable with said cam and another end associated with said slide to move said slide to and fro.

4. A device according to claim 3, wherein said slide further includes a bearing, a forked member is pivotally mounted to said support having a forked end engageable with said slide bearing and said forked member being connected to said lever for moving said slide to and fro.

5. A device according to claim 1, wherein said jaw further comprises a pair of arms pivotally connected to said slide, said pin includes an inclined portion and a flat enlarged portion, and a bearing is disposed between said pin and each of said arms for holding said jaw open when said pin is in its first position and said bearing is between each of said arms and said enlarged pin portion, and for closing said jaw when said pin is in its second position with said bearing disposed between each of said arms and a base of said inclined portion.

6. A device according to claim 5, wherein said jaw further includes a biasing means for urging said jaw into its closed position.

7. A device according to claim 1, wherein said slide further includes a transverse bar disposed between said jaw and above said pin including a portion abuttable against said setting means during each fro movement of said slide for pushing each of the capped containers out of said closed jaw.

8. A device according to claim 1, wherein the containers comprise vials having a neck that is preheated to open the vial and form an uncapped container.

* * * * *